US011412874B1

(12) United States Patent
Dwomoh

(10) Patent No.: US 11,412,874 B1
(45) Date of Patent: Aug. 16, 2022

(54) SPRING BIASED CLOTHES HANGER

(71) Applicant: Kwame Dwomoh, Quantico, VA (US)

(72) Inventor: Kwame Dwomoh, Quantico, VA (US)

( * ) Notice: Subject to any disclaimer, the term of this patent is extended or adjusted under 35 U.S.C. 154(b) by 0 days.

(21) Appl. No.: 16/812,773

(22) Filed: Mar. 9, 2020

(51) Int. Cl.
*A47G 25/40* (2006.01)

(52) U.S. Cl.
CPC ..... *A47G 25/40* (2013.01); *A47G 2025/4092* (2013.01)

(58) Field of Classification Search
CPC ..... A47G 25/40; A47G 2025/4092; A47G 25/4023; A47G 25/4076; A47G 25/447; A47G 25/24; A47G 25/1485; A47G 25/16; A47G 25/20; A47G 25/26; A47G 25/28; A47G 25/30; A47G 25/4015
See application file for complete search history.

(56) References Cited

U.S. PATENT DOCUMENTS 1,769,076 A * 7/1930 Shrack ..... A47G 25/40 223/94
2,595,026 A * 4/1952 Varker ..... A47G 25/4023 223/94
2,728,499 A * 12/1955 Mueller ..... A47G 25/4023 223/94
4,227,632 A * 10/1980 Collis ..... A47G 25/4023 223/94
4,948,019 A * 8/1990 Rodum ..... A47G 25/4023 223/89
5,590,823 A * 1/1997 Lunde ..... A47G 25/4023 223/94
5,826,759 A * 10/1998 Ohsugi ..... A47G 25/183 223/85
6,540,121 B1 * 4/2003 Harvey ..... A47G 25/4023 223/85
7,021,507 B2 * 4/2006 Choi ..... A47G 25/32 223/94
7,694,859 B1 * 4/2010 Whittaker ..... A47G 25/4023 223/94
7,743,954 B2 * 6/2010 Chiu ..... A47G 25/4023 223/89
8,430,283 B2 * 4/2013 Chung ..... A47G 25/4023 223/94
8,770,452 B1 * 7/2014 Gottlieb ..... A47G 25/20 223/92

* cited by examiner

*Primary Examiner* — Ismael Izaguirre
(74) *Attorney, Agent, or Firm* — Sanchelima & Associates PA; Christian Sanchelima; Jesus Sanchelima

(57) ABSTRACT

A spring biased clothes hanger is disclosed. The folding clothes hanger includes a bar hook, a pair of adjustable length shoulder bars and an internal spring or string connectors. The combination of these elements allows the shoulder bars to bend downwardly or horizontally for placing the clothes on the hanger through the neck opening without unbuttoning the garment or stretching the neck elastic band. At least two spring connectors are coupled to the shoulder bars to then form a cross configuration. The spring connectors include clipper members which are then coupled to the bar hook for operation by a user. A user may then apply a squeezing force to the clipper members which then actuate the shoulder bars into a downward position or a compressed horizontal position.

13 Claims, 4 Drawing Sheets

SPRING BIASED CLOTHES HANGER

BACKGROUND OF THE INVENTION

1. Field of the Invention

The present invention relates to a clothes hanger and, more particularly, to a clothes hanger with a mechanical apparatus that facilitates the bending of shoulder bars of the clothes hanger.

2. Description of the Related Art

Several designs for a clothes hanger have been designed in the past. None of them, however, include a folding clothes hanger including a bar hook, a pair of adjustable length shoulder bars and an internal spring or string connectors. The combination of these elements allows the shoulder bars to bend downwardly or horizontally for placing the clothes on the hanger through the neck opening without unbuttoning the garment or stretching the neck elastic band. At least two spring connectors are coupled to the shoulder bars to then form a cross configuration. The spring connectors include clipper members which are then coupled to the bar hook for operation by a user. A user may then apply a squeezing force to the clipper members which then actuate the shoulder bars into a downward position or a compressed horizontal position. A user may then insert the hanger into a shirt garment without altering or stretching the shirt garment. It is known that traditional clothes hangers often require that a user apply a stretching force to a shirt garment before inserting the hanger. The stretching of the shirt garment may cause damage to the shirt by ruining the elasticity of the shirt and providing unwanted wrinkles. Traditional hangers also require that a user unbutton a shirt garment before inserting the hanger therein. This process proves to be very time consuming especially when hanging a large number of shirts. Therefore, there is a need for a spring biased clothes hanger to make the process of hanging a shirt more efficient and effortless.

Applicant believes that a related reference corresponds to U.S. Pat. No. 7,743,954 issued for a clothes hanger comprising shoulder bars which are spring biased to be folded together when inserted into a shirt neck and then extended into place thereafter. Applicant believes that another related reference corresponds to U.S. Pat. No. 4,227,632 issued for a flexible bending garment hanger. However, the cited references differ from the present invention because the fail to disclose the X-shaped configuration of the spring connectors. The spring connectors are then attached to the shoulder bars of a hanger. The present invention utilizes the clipper members to then actuate the shoulder bars in a downward position or a horizontally compressed position. The present invention includes clear structural benefits over the prior art.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a clothes hanger that prevents the stretching of fabric or the unbuttoning of a shirt when inserting the clothes hanger within the shirt.

It is another object of this invention to provide a clothes hanger with shoulder bars that are compressed in a horizontal configuration to allow for easy insertion into a shirt garment.

It is still another object of the present invention to provide a clothes hanger that provides front and back easy access maneuverability and can be used or operated from both sides.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
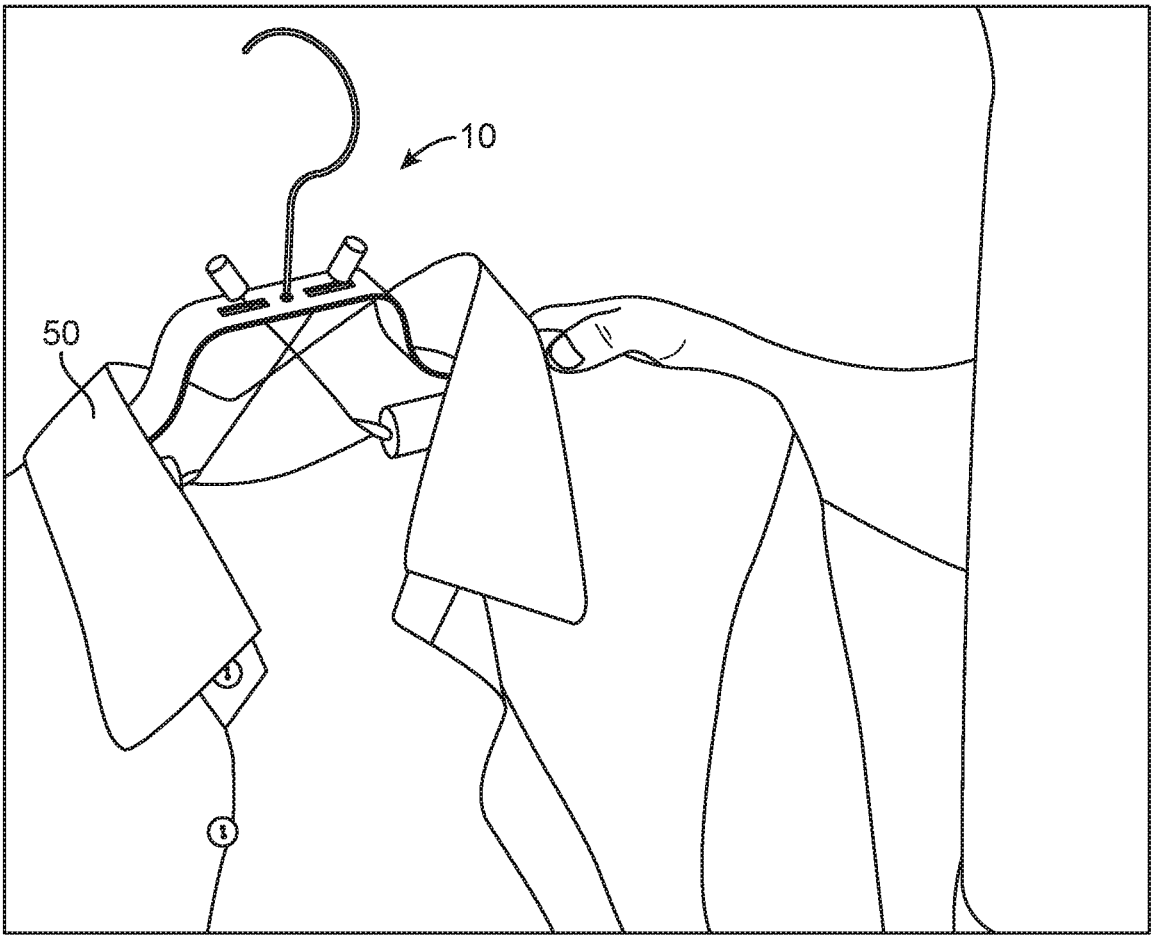
FIG. 1 represents an operational isometric view of clothes hanger 10 in accordance to an embodiment of the present invention.
Figure 2:
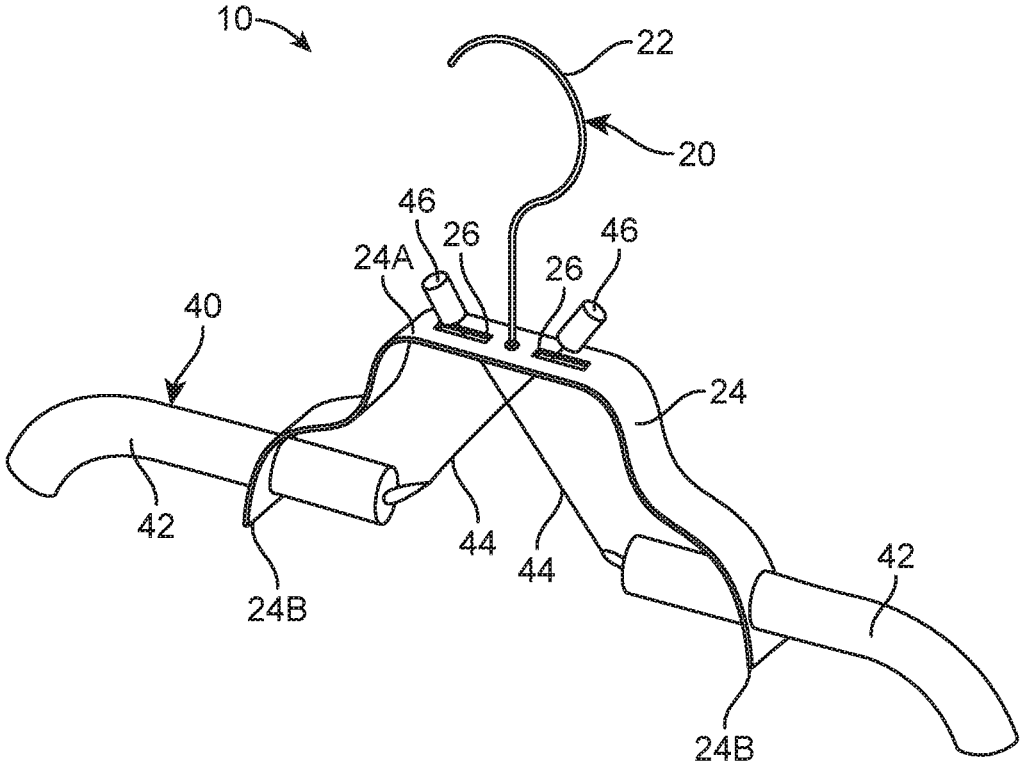
FIG. 2 shows an isometric view of clothes hanger 10 depicting components of hanger assembly 20 and shoulder assembly 40 in accordance to an embodiment of the present invention.

Referring now to the drawings, where the present invention is generally referred to with numeral 10, it can be observed a clothes hanger 10 which basically includes a hanger assembly 20 and a shoulder assembly 40.

Hanger assembly 20 includes a hanger that is provided with a hook portion 22 and a body portion 24. In one embodiment, hanger assembly 20 may be made of a plastic, wood, metal, rubber or any degradable material and substance. In another embodiment, hanger assembly 20 is made of a metallic wire material. Additionally, hanger assembly 20 must be of a suitable size to support a clothing garment 50. Body portion 24 includes a top end 24B and bottom ends 24B. Bottom ends 24B may be provided as vertical bottom ends which face a downward direction. Other embodiments of the present invention may feature bottom ends 24B being horizontal instead of being vertical. Furthermore, body portion 24 may also have a thickness which is utilized to provide further support to clothing garment 50. Top end 24A may be provided as a substantially flat top portion. Additionally, top end 24A further includes slit openings 26 extending therethrough. Slit openings 26 are utilized to receive and effectively mount shoulder assembly 60 in one embodiment of the present invention. In one implementation, slit openings 26 are provided having a rectangular shape. Other implementations may feature different shapes of slit openings 26 and may even feature circular openings instead.

Figure 3:
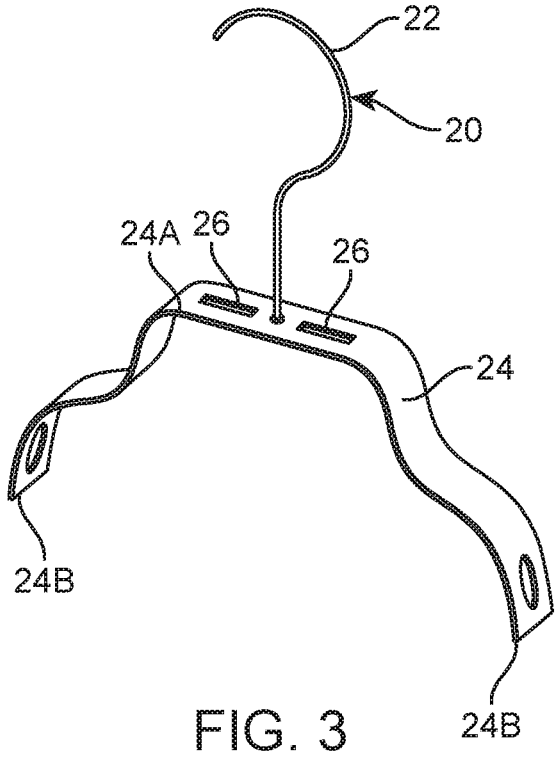
FIG. 3 illustrates an isometric view of hanger assembly 20 in accordance to an embodiment of the present invention.

In one embodiment, hook portion 22 is integrally mounted to top end 24A of body portion 24. Hook portion 22 is provided as a standard hook member which may be hanged onto a clothes rack to support clothes thereon. Additionally, hook portion 22 may be mounted in between slit openings 26. In an exemplary embodiment, two slit openings 26 are provided as observed in FIG. 3 of the provided drawings. Hook portion 22 is then mounted in between these two slit openings 26. In one implementation, hook portion 22 is rotatable along an axis point of top end 24A. As a result, hook portion 22 may be rotated in a clockwise or counterclockwise position. This allows a cloth hanger to receive hook portion 22 in any direction. A user does not need to then worry about which position they are hanging clothes hanger 10 as the position can always be adjusted.

Shoulder assembly 40 includes shoulder bars or members 42 each having a first end 22A and a second end 22B. In one embodiment, shoulder assembly 40 is provided being made of the same material as hanger assembly 20. Other embodiments may feature a shoulder assembly 40 made of varying materials. Shoulder bars 42 are then mounted onto body portion 24 in a horizontal configuration. The horizontal configuration provides the most optimal configuration to receive clothing garment 50 thereon. In one embodiment, clothing garment 50 is provided as a shirt having a neck opening. It should be understood that clothing garment 50 is not limited to being a shirt and any form of clothing may be utilized with clothes hanger 10. First end 42A of shoulder bars 42 are mounted near each of bottom ends 24B of body portion 24. Shoulder bars 42 are mounted in such a way that they are freely allowed to move and may travel horizontally, independently from body portion 24. Other embodiments may feature shoulder bars 42 integrally mounted to body portion 24. Second end 42B of each shoulder bars 42 may be provided as curved ends. The curved ends allow for clothing garment 50 to more easily receive shoulder bars 42.

Figure 4:
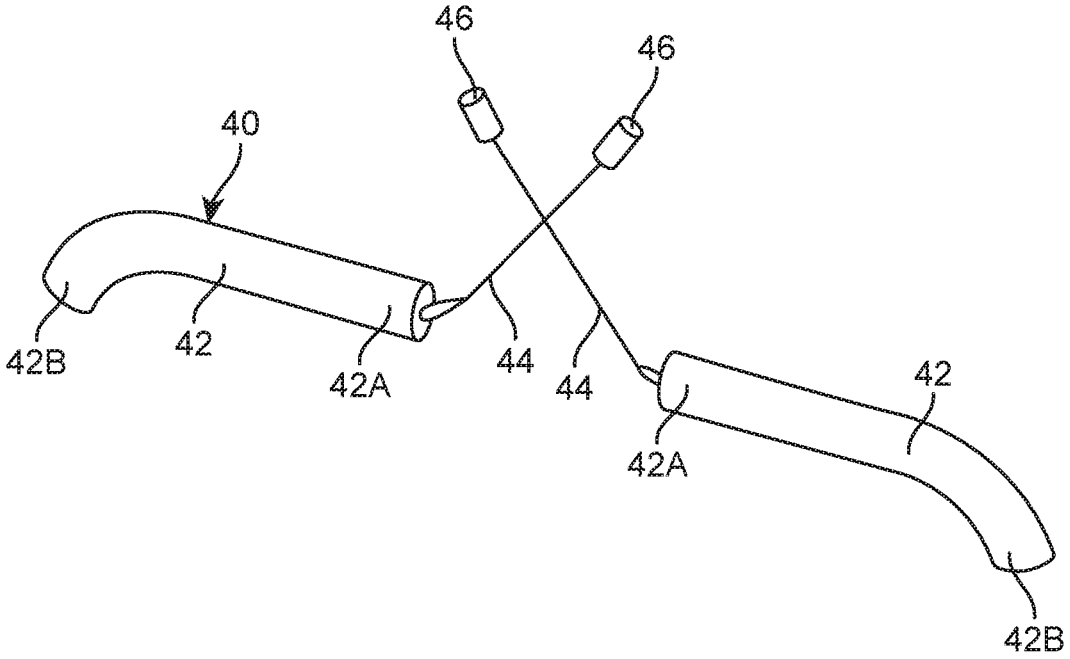
FIG. 4 is a representation of an isometric view of shoulder assembly 40 in accordance to an embodiment of the present invention.

Shoulder assembly 40 further includes spring members 44 that are coupled to shoulder bars 42. In one embodiment, spring members 44 are springs having a predetermined spring constant suitable for use with clothes hanger 10. In another embodiment, a string member may be used in lieu of spring members 44. These spring members may be made of a string material similar to that used in guitar strings. Spring members 44 are then coupled to an inner portion of shoulder members 42. In one implementation as observed in FIG. 4, two of spring members 44 are provided. Spring members 44 are then positioned to form a cross shaped configuration. In the present embodiment, this configuration resembles an X-shape. Furthermore, spring members 44 are then inserted through slit openings 26 of hanger assembly 20. Spring members may be provided as any suitable member which creates the necessary tension needed to operate shoulder bars 42 in the desired configuration. Neck clippers 46 are then mounted to a top end of spring members 44 that are passing through slit openings 26. Neck clippers 46 may be provided as gripping members and create an effective mounting means for spring members 44 on body portion 24. In one implementation, neck clippers 44 are provided as cylindrical members. In another implementation, neck clippers 44 may be made of a rubber material to increase the grip of a user grasping the clippers. Other implementations may feature neck clippers 44 being made of other suitable gripping materials. Additionally, hook portion 22 may have a height that is greater than neck clippers 44 such that neck clippers 44 are shorter than hook portion 22.

Figure 5:
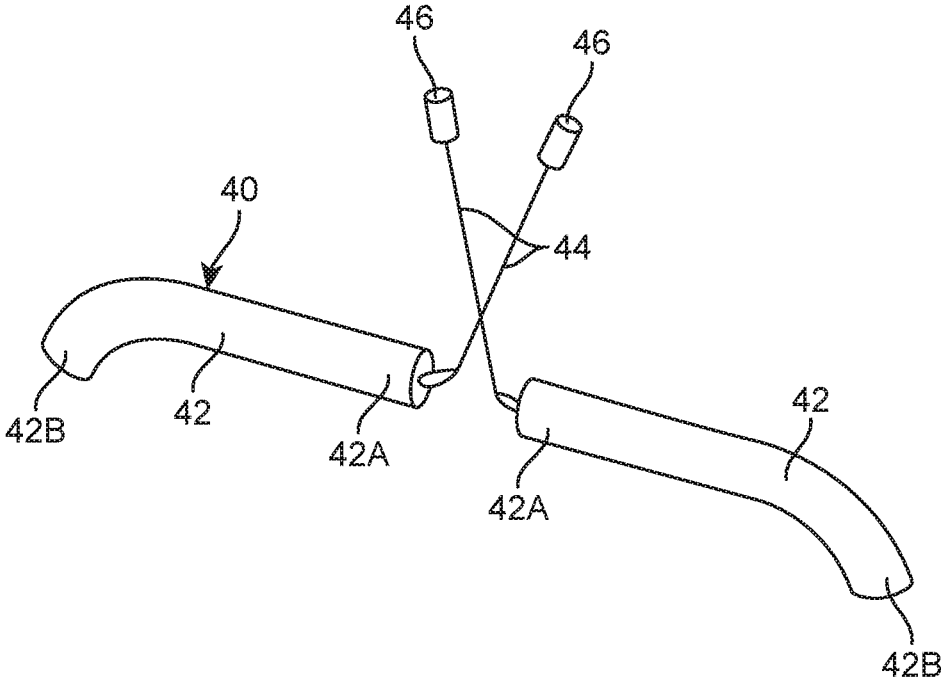
FIG. 5 shows an isometric view of shoulder assembly 40 in a compressed configuration is accordance to an embodiment of the present invention.

In one example, a squeezing force is applied to neck clippers 46. As the squeezing force is applied, this causes the spring members 44 that are formed in a cross configuration to begin to compress. As the spring members 44 compress, shoulder bars 42 are then actuated to begin to compress and move inwardly in a horizontal configuration. This compressed configuration can be observed in FIG. 5 of the provided drawings. As a result, the total width of clothes hanger 10 is effectively reduced. This reduction in width aids a user in inserting clothes hanger 10 into clothing garment 50. A user may insert clothes hanger 10 within a shirt without having to stretch the fabric of the collar of the shirt. It is known that the stretching of the fabric often ruins and wrinkles the shirt. Additionally, the reduced width enables a user to insert clothes hanger 10 into a button up shirt without having to un-button the shirt. As a result, a user saves time and effort and prevents the buildup of wrinkles on the shirt. When the squeezing force is released from neck clippers 46, the shoulder bars 42 then return to their extended position.

Figure 6:
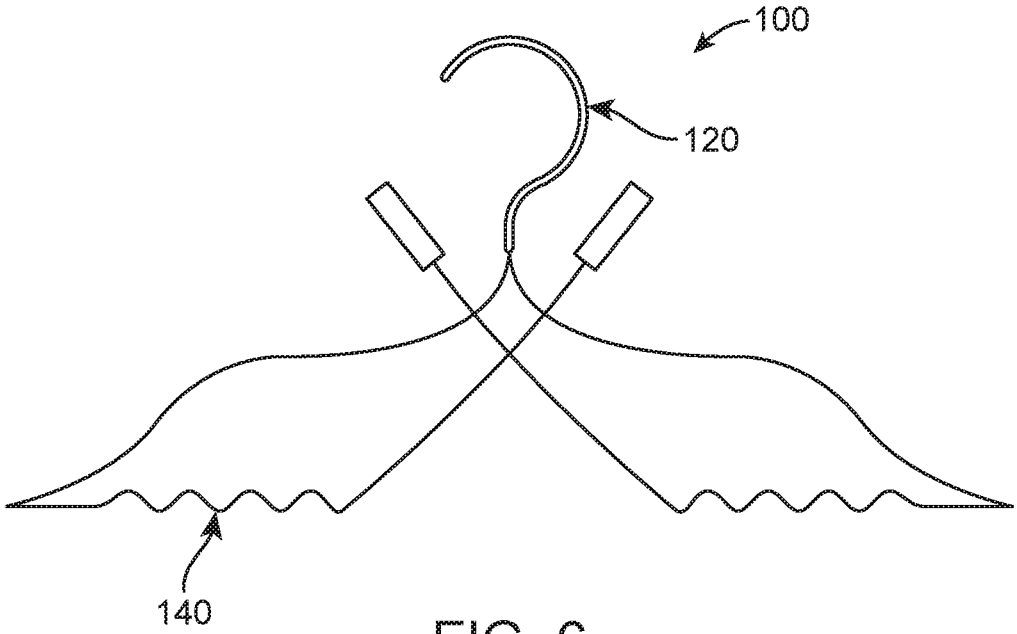
FIG. 6 illustrates an isometric view of clothes hanger 100 in accordance to an embodiment of the present invention.
Figure 7:
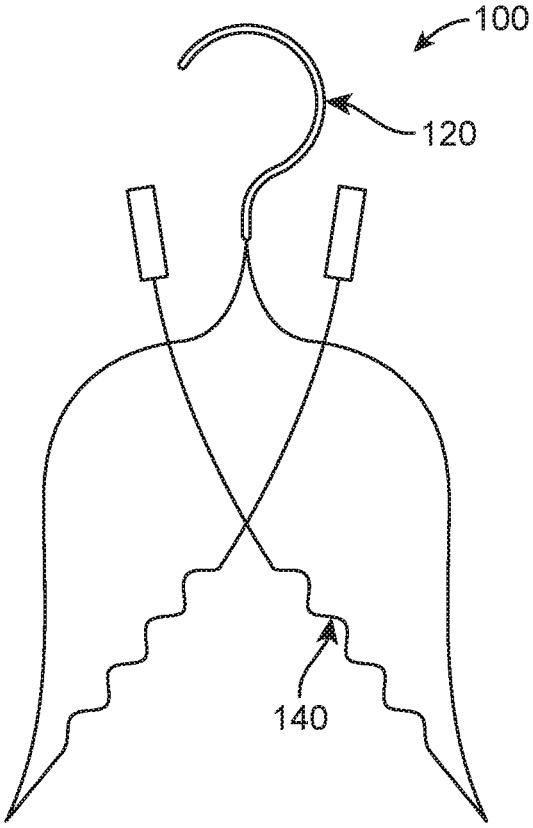
FIG. 7 represents an isometric view of clothes hanger 100 having shoulder assembly 140 compressed in a downward configuration in accordance to an embodiment of the present invention.

In another embodiment of the present invention, clothes hanger 100 as depicted in FIGS. 6 and 7, include a shoulder assembly 140 that may be folded into a vertical configuration. In this embodiment, shoulder assembly 140 is provided integrally to a hanger assembly 120. A user then applies a squeezing force to neck clippers of the shoulder assembly 140 to then compress vertically. The shoulder assembly 140 then extends downwardly and allows for a user to easily insert the hanger within a clothing garment.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a clothes hanger, comprising:

a. a hanger assembly including a hanger having a body portion and a hook portion, said body portion having a top end, a left distal end that is pointing downward, and a right distal end that is pointing downward, said hook portion mounted to a top end of said body portion, said top end further including slit openings thereon; and b. a shoulder assembly including a right shoulder bar and a left shoulder bar, said right shoulder member is mounted orthogonally to said right distal end, said left shoulder member is mounted orthogonally to said left distal end, spring connectors coupled to an inner side of said shoulder bars and inserted through said slit openings, wherein said spring connectors have a cross shaped configuration, neck clippers coupled to a top of said spring connectors, wherein a squeezing force is applied to said neck clippers to then bring said shoulder bars into a compressed configuration.

2. The system for a clothes hanger of claim 1 wherein said hook portion is mounted between two slit openings located on said top end of said body portion.

3. The system for a clothes hanger of claim 1 wherein said hook portion is rotatable in a clockwise or counterclockwise position on said body portion.

4. The system for a clothes hanger of claim 1 wherein said hook portion and said body portion is made of a metallic wired material.

5. The system for a clothes hanger of claim 1 wherein said body portion includes two vertical bottom ends.

6. The system for a clothes hanger of claim 1 wherein said compressed configuration is a horizontally compressed configuration.

7. The system for a clothes hanger of claim 1 wherein said extended configuration is a vertically extended configuration.

8. The system for a clothes hanger of claim 1 wherein said hook portion includes a height extending above said gripping members.

9. The system for a clothes hanger of claim 1 wherein said shoulder bars are configured to be inserted through a neck opening of a garment.

10. The system for clothes hanger of claim 1, wherein said neck clippers are thumb-sized fasteners that when pressed send tension to the spring connectors which extend and lower the shoulder members, when the neck clippers are released the spring connectors permit the shoulder members to return at a compressed position.

11. The system for a clothes hanger of claim 1, wherein said right shoulder member and said left shoulder member are movable parts that extends and retracts when said neck clippers are pressed and released.

12. A system for a spring biased clothes hanger, comprising:

b. a hanger assembly including a hanger having a hook portion and a body portion, wherein said body portion includes a right vertical bottom end, a left vertical bottom end, and a top end, wherein said top end includes a top right slit opening and a top left slit opening thereon, said right vertical bottom end includes a right bottom slit, said left vertical bottom end includes a left bottom slit, wherein said hook portion is integrally mounted to said top end of said body portion, wherein said hook portion is rotatable, wherein said hook portion is located in between said top right slit opening and said top left slit opening, wherein said hook portion and said body portion are each made of a metallic wire material; and c. a shoulder assembly including a right shoulder member and a left shoulder member, each shoulder member includes a distal end and a proximal end, said right shoulder member is mounted orthogonally to said right vertical bottom end, said left shoulder member is mounted orthogonally to said left vertical bottom end, said proximal end of said right shoulder member is passed through said right bottom slit, said proximal end of said left shoulder member is passed through said left bottom slit, the distal end of said right shoulder member and the distal end of said left shoulder member are curved, the shoulder members are configured to extend and retract through their respective bottom slit, a first spring connecting member is attached to said proximal end of said right shoulder member, said first spring connecting member is then passed through said top left slit opening, a first neck clipper is then used to secure said first spring connecting member, a second spring connecting member is attached to said proximal end of said left shoulder member, said second spring connecting member is then passed through said top right slit opening, a second neck clipper is then used to secure said second spring connecting member, in this configuration said first spring connecting member crosses diagonally the body portion from a right vertical bottom end to a top left slit opening and said second spring connecting member crosses diagonally the body portion from a left vertical bottom end to a top right slit opening, the two neck clippers are thumb-sized fasteners that when pressed send tension to their corresponding spring connecting member which extend and lower their corresponding shoulder member calling this an extended configuration, when the two neck clippers are released from the pressing force the spring connecting members return said shoulder members to a compressed position calling this a compressed configuration.

13. A system for a spring biased clothes hanger, consisting of:

a. a hanger assembly including a hanger having a hook portion and a body portion, wherein said body portion includes a right vertical bottom end, a left vertical bottom end, and a top end, wherein said top end includes a top right slit opening and a top left slit opening thereon, said right vertical bottom end includes a right bottom slit, said left vertical bottom end includes a left bottom slit, said hook portion is integrally mounted to said top end of said body portion, said hook portion is rotatable, wherein said hook portion is located in between said top right slit opening and said top left slit opening, wherein said hook portion and said body portion are each made of a metallic wire material; and b. a shoulder assembly including a right shoulder member and a left shoulder member, said right shoulder member has a cylindrical shape, said left shoulder member has a cylindrical shape, each shoulder member includes a distal end and a proximal end, said right shoulder member is mounted orthogonally to said right vertical bottom end, said left shoulder member is mounted orthogonally to said left vertical bottom end, said proximal end of said right shoulder member is passed through said right bottom slit, said proximal end of said left shoulder member is passed through said left bottom slit, the distal end of said right shoulder member and the distal end of said left shoulder member are curved, the shoulder members are configured to extend and retract through their respective bottom slit, a first spring connecting member is attached to said proximal end of said right shoulder member, said first spring connecting member is then passed through said top left slit opening, a first neck clipper is then used to secure said first spring connecting member, a second spring connecting member is attached to said proximal end of said left shoulder member, said second spring connecting member is then passed through said top right slit opening, a second neck clipper is then used to secure said second spring connecting member, in this configuration said first spring connecting member crosses diagonally the body portion from a right vertical bottom end to a top left slit opening and said second spring connecting member crosses diagonally the body portion from a left vertical bottom end to a top right slit opening, the two neck clippers are thumb-sized fasteners that when pressed send tension to their corresponding spring connecting member which extend and lower their corresponding shoulder member calling this an extended configuration, when the two neck clippers are released from the pressing force the spring connecting members return said shoulder members to a compressed position calling this a compressed configuration.

* * * * *